US006503446B1

(12) United States Patent
Ren et al.

(10) Patent No.: US 6,503,446 B1
(45) Date of Patent: Jan. 7, 2003

(54) CORROSION AND GRAIN GROWTH RESISTANT ALUMINUM ALLOY

(75) Inventors: Baolute Ren, Glen Allen, VA (US); Subhasish Sircar, Richmond, VA (US); William A. Cassada, III, Richmond, VA (US)

(73) Assignee: Reynolds Metals Company, Richmond, VA (US)

( * ) Notice: Subject to any disclaimer, the term of this patent is extended or adjusted under 35 U.S.C. 154(b) by 0 days.

(21) Appl. No.: 09/616,015

(22) Filed: Jul. 13, 2000

(51) Int. Cl.[7] ..... C22C 21/00
(52) U.S. Cl. ..... 420/540; 420/551; 420/553
(58) Field of Search ..... 420/540, 550, 420/551, 553

(56) References Cited

U.S. PATENT DOCUMENTS

| | | | | |
|---|---|---|---|---|
| 3,878,871 A | | 4/1975 | Anthony et al. | |
| 4,649,087 A | | 3/1987 | Scott et al. | |
| 4,749,627 A | | 6/1988 | Ishikawa et al. | |
| 4,828,794 A | | 5/1989 | Scott et al. | |
| 5,125,452 A | | 6/1992 | Yamauchi et al. | |
| 5,286,316 A | | 2/1994 | Wade | |
| 5,503,690 A | | 4/1996 | Wade et al. | |
| 5,906,968 A | | 5/1999 | Sircar | |
| 5,976,278 A | | 11/1999 | Sircar | |
| 6,065,534 A | * | 5/2000 | Sircar | 165/178 |

FOREIGN PATENT DOCUMENTS

| | | |
|---|---|---|
| EP | 0893512 | 1/1999 |
| EP | 0899350 | 3/1999 |
| JP | 57203743 | 12/1982 |
| JP | 5125472 | 5/1993 |
| JP | 5148572 | 6/1993 |
| JP | 5263172 | 10/1993 |
| JP | 5271833 | 10/1993 |
| JP | 5320798 | 12/1993 |
| JP | 6212371 | 8/1994 |
| WO | WO 91/14794 | 10/1991 |
| WO | WO 93/20253 | 10/1993 |
| WO | 97/46726 | * 12/1997 |
| WO | WO 99/04050 | 1/1999 |
| WO | WO 99/04051 | 1/1999 |

OTHER PUBLICATIONS

"Standard Proctice for Modified Salt Spray (Fog) Testing", American Society for Testing and Materials, Designation: G 85–94, pp. 350–355, Apr. 1994.

J.R. Galvele et al., "Mechanism of Intergranular corrosion of A1–Cu Alloys", pp. 795–807, presented at the 4th International Congress on Metallic Corrosion, Amsterdam, Sep. 7–14, 1969.

Ahmed, "Designing of an Optimum Aluminum Alloy for De–salination Applications", pp. 255–261, Strength of Metals and Alloys, vol. 1, Proceeding of the 6th International Conference, Melbourne, Australia, Aug. 16–20, 1982.

I.L. Muller et al., Pitting Potential of High Purity Binary Aluminum Alloys—1; pp. 180–183, 186–193, 1977.

* cited by examiner

*Primary Examiner*—George Wyszomierski
*Assistant Examiner*—Janelle Morillo
(74) *Attorney, Agent, or Firm*—Christopher W. Brody; David Pearce-Smith

(57) ABSTRACT

An aluminum alloy composition includes controlled amounts of iron, manganese, zinc, zirconium, vanadium, and titanium to effectively inhibit grain growth during exposure to elevated temperatures while maintaining extrudability and corrosion resistance. The composition is especially adapted for use as micro-multivoid tubing for brazed heat exchanger applications and has a post-braze grain structure that is more resistant to intergranular corrosion so as to reduce or eliminate heat exchanger failures during service.

26 Claims, 2 Drawing Sheets

CORROSION AND GRAIN GROWTH RESISTANT ALUMINUM ALLOY

FIELD OF THE INVENTION

The present invention is directed to a corrosion and grain growth resistant aluminum alloy, and particularly to an alloy composition and article having controlled levels of iron, manganese, zinc, zirconium, vanadium, titanium and other elements that is particularly adapted for use in heat exchanger applications.

BACKGROUND ART

In the prior art, aluminum alloys are the alloys of choice for heat exchanger applications. These alloys are selected for their desirable combination of strength, low weight, and good thermal and electrical conductivities. Some aluminum alloys may also exhibit another characteristic such as improved brazeability. Other alloys may have better formability, while others yet may exhibit good extrudability or have desirable corrosion resistance.

When an aluminum alloy component is in a corrosive environment, a common practice is to coat the aluminum alloy component with zinc for corrosion protection. This zinc is applied using a plasma spraying technique. When the alloy is in the form of a flat tube as shown in FIG. 1, it is preferred to employ the plasma spraying technique; round tubing does not lend itself to good zinc coverage when sprayed due to its curved surface.

No matter how the zinc is applied, zinc in the workplace presents a number of environmental and safety problems. When applying zinc using plasma techniques, the guns employed for such purposes are extremely loud and cause considerable noise pollution. Further, since cooling is a part of the zinc coating process, contamination of the cooling water with zinc is inevitable, and a considerable water pollution problem then exists. Zinc is also a health hazard, and OSHA has strict regulations concerning the handling of zinc and levels of zinc dust/fumes present in the workplace.

Besides the problems of zinc itself, zinc-coated aluminum products can also be problematic if the zinc coating is not uniform or is compromised. For example, a non-uniform coating or surface scratches creates local sites where the aluminum metal is exposed. These exposed local sites or cells may then corrode in a more accelerated manner than if the aluminum was not coated at all, and premature failure may occur during service.

The zinc coating processes are also expensive and contribute to the overall cost of the product being manufactured in terms of both material and operating costs. In addition, if the zinc processing equipment fails, the entire production line may be halted. As a result, productivity of the entire manufacturing line is compromised. As such, a need exists to eliminate zinc coating and provide adequate corrosion resistance in the base material itself.

Typical applications for the aluminum alloys discussed above include automotive heater cores, radiators, evaporators, condensers, charge air coolers, and transmission/engine oil coolers. One particular application that requires demanding properties is flat tubing that is employed in heat exchangers. In these applications, fin stock is arranged between stacked tubing that carries the cooling media. The tubing is situated between headers which redirect the cooling media flow between layers of tubing and which also can contain inlets and outlets. Typically, the fin stock is clad with a brazing material and the entire assembly is brazed together in a controlled atmosphere braze (CAB) process using a brazing flux. The flat tubing may be extruded as a multi-channel tubing, commonly referred to as micro-multivoid tubing (MMV tubing).

FIG. 1 shows a partial cross sectional view of a typical MMV tubing designated by the reference numeral 10. The portion of the MMV tubing depicted has sidewalls 1, each joined together by endwalls 3 (one shown). The tubing is separated into a series of voids 5 by walls 7 extending between the sidewalls 1. In certain applications, the MMV tubing is extruded at extremely light gauges, often times with sidewall thicknesses below 0.020 inches (0.51 mm).

Typically, these types of tubing are made from AA1000 series alloys such as AA1100, as well as AA3000 series alloys like 162 and 171.

One significant problem with this type of tubing is an increased number of failures in service due to corrosion. When this tubing is used in heat exchanger manufacture, stacked tubing is arranged with two sided braze clad fin stock positioned therebetween and the assembly is brazed together. During the brazing cycle, the tubing may see temperatures near its melting point and severe grain growth effects are prevalent.

Referring to FIG. 2, a cross sectional portion 9 of the MMV tubing of FIG. 1 is shown with an exemplary post-braze grain structure 20. As described above, when the MMV tubing is subjected to brazing temperature, significant grain growth can occur such that a single grain 11 can extend across the sidewall 1. With the formation of a single grain across the sidewall 1, a single grain boundary 13 can extend from the outer surface 15 of the sidewall to the inner surface 17 in one of the voids 7. The grain boundary 13 becomes an easy path for corrosion to occur through the tubing sidewall 1. This is more pronounced because the grain body is relatively much more corrosion resistant. Hence, the grain boundary is the weaker link for corrosion.

As noted above, a myriad of problems also exist in this field of aluminum alloys and heat exchanger applications when zinc is used as a coating agent.

Accordingly, a need has developed to provide an improved material for heat exchanger use, particularly MMV tubing, which overcomes the drawbacks to the prior art problems noted above. The present invention solves this need by providing an aluminum alloy composition having controlled amounts of iron, manganese, zinc, zirconium, vanadium, titanium, and other elements that effectively inhibit excessive grain growth in thin wall structures when exposed to brazing temperatures, while still maintaining extrudability and corrosion resistance.

SUMMARY OF THE INVENTION

Accordingly, it is a first object of the present invention to provide an improved aluminum alloy composition that is ideally suited for use in heat exchanger applications.

Another object of the present invention is a composition having controlled amounts of iron, manganese, zinc, zirconium, vanadium, titanium, and other elements to inhibit grain growth when the composition is exposed to brazing temperatures while still maintaining extrudability and corrosion resistance.

A still further object of the present invention is a method of brazing which utilizes an aluminum alloy composition as extruded and bare or uncoated tubing for heat exchanger applications.

Yet another object of the invention is an aluminum alloy base material that has adequate corrosion resistance but without the presence of a zinc coating.

One other object of the present invention is a method of making extruded MMV tubing using the inventive aluminum alloy composition.

Other objects and advantages of the present invention will become apparent as a description thereof proceeds.

In satisfaction of the foregoing objects and advantages, the present invention provides a novel aluminum alloy composition consisting essentially of, in weight percent;

between about 0.05 and 0.5% silicon;

up to 0.7% copper;

less than 0.01% nickel;

less than or equal to 1.0% magnesium;

up to 0.5% chromium, and when iron is between zero and 0.09%, the composition consists essentially of:

an amount of manganese between 0.05% and 0.50%, an amount of zinc between 0.10 and 0.50%, and an amount of zirconium between 0.05 and 0.40%, and additional amounts of one of (a), (b), or (c), wherein:

(a) is an additional amount of manganese up to 0.70%, or an amount of vanadium between 0.05 and 0.50%;

(b) is either an additional amount of manganese up to 0.70% and an amount of titanium between about 0.10 and 0.40%, or an additional amount of manganese up to 0.70% and an amount of vanadium between 0.05 and 0.50%; and (c) is an additional amount of manganese up to 0.70%, and an amount of titanium between 0.10 and 0.40%, and an amount of vanadium between 0.05% and 0.50%;

with the balance aluminum and inevitable impurities; and when iron is between 0.09% and 0.80%, the composition includes:

an amount of manganese between 0.05% and 2.00%, and an amount of zinc between 0.10 and 0.50%; and additional amounts of one of (a), (b), or (c), wherein:

(a) is an amount of titanium between 0.10 and 0.40%, or an amount of vanadium between 0.05 and 0.50%, or an amount of zirconium between 0.05% and 0.40%;

(b) is either an amount of titanium between about 0.10 and 0.40% and an amount of vanadium between 0.05 and 0.50%, or an amount of titanium between 0.10 and 0.40% and an amount of zirconium between 0.05 and 0.40%; or and an amount of vanadium between 0.05 and 0.50% and an amount of zirconium between 0.05 and 0.40%; and (c) is an amount of zirconium between 0.05% and 0.40%, and an amount of titanium between 0.10 and 0.40%, and an amount of vanadium between 0.05% and 0.50%; with the balance aluminum and inevitable impurities.

In a more preferred embodiment, the alloying element ranges for the low iron embodiment are: manganese between about 0.2 and 1.0%, more preferably between about 0.3 and 0.8%; titanium between about 0.10 and 0.20%, more preferably between about 0.12 and 0.18%; vanadium between about 0.10 and 0.35%, more preferably 0.10 and 0.25%, zirconium between about 0.10 and 0.30%, more preferably between about 0.10 and 0.25%, and zinc between about 0.10 and 0.40%, more preferably between about 0.10 and 0.30%.

The high iron embodiment has preferred alloying element ranges of: manganese between about 0.2 and 1.5%, more preferably between about 0.3 and 1.2%; zinc between about 0.10 and 0.40%, more preferably between about 0.10 and 0.30%; titanium between about 0.10 and 0.20%, more preferably between about 0.12 and 0.18%; vanadium between about 0.10 and 0.35%, more preferably 0.10 and 0.25%, and zirconium between about 0.10 and 0.30%, more preferably between about 0.10 and 0.25%.

More preferred embodiments include the low iron composition with vanadium alone, manganese alone, or the combination of zirconium and titanium.

For high iron, more preferred embodiments include the use of titanium or titanium and zirconium.

Another aspect of the invention entails a method of brazing one article to another article under elevated temperature and in the presence of a brazing material. The one article is formed from the inventive aluminum alloy composition as described above, whereby the alloying elements of the alloy composition form a fine grain microstructure when subjected to the elevated temperatures due to brazing. Preferably, the one article is bare tubing, and more preferably bare micro-multivoid tubing, and the other article is heat exchanger fin stock or header block(s). For brazing operations, the elevated temperature ranges between about 500 and 650° C. In the post-braze state, the tubing, due to its grain growth resistant composition, has a plurality of grains traversing side and end walls to form a fine grained structure that better resists intergranular corrosion effects.

In another aspect of the invention, the inventive aluminum alloy composition is formed into a shape and hot worked by heating the workpiece to an elevated temperature and subjecting the shape to hot working to form an article. In a preferred mode, the hot working is extrusion, and the extruded shape is an elongated hollow article such as tubing. In a more preferred embodiment, the extruded shape is flat micro-multivoid tubing for heat exchanger use. Given the corrosion resistance of the composition, the tubing can be used in its bare condition for brazing. The inventive composition has excellent corrosion resistance, grain growth resistance, and hot workability, making it ideal for use in heat exchanger applications.

BRIEF DESCRIPTION OF THE DRAWINGS

Reference is now made to the drawings of the invention wherein.

DESCRIPTION OF THE PREFERRED EMBODIMENTS

Figure 1:
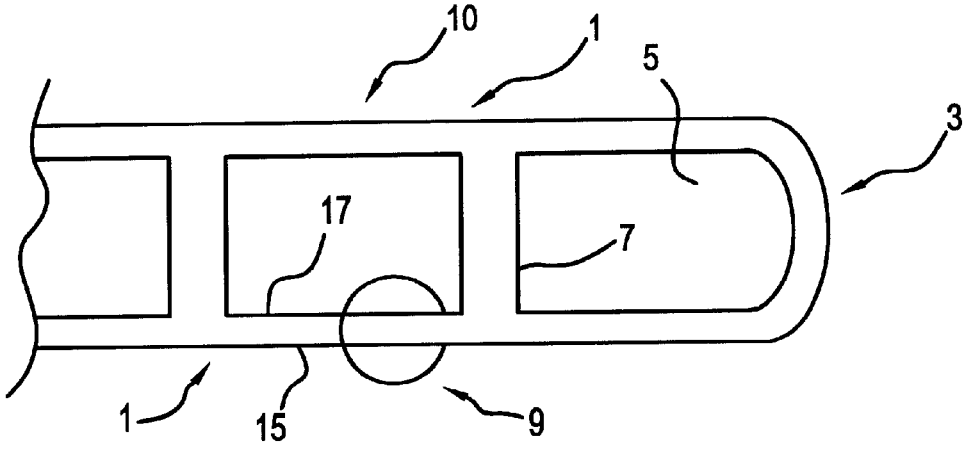
FIG. 1 PRIOR ART
FIG. 1 shows a partial cross sectional view of a typical MMV tubing configuration.

The inventive composition offers significant advantages over prior art compositions in terms of corrosion resistance, hot workability, grain growth resistance, and desirable post-braze grain structure. Using the controlled chemistry of the invention, an article can be made which exhibits excellent corrosion resistance and the extrudability necessary to meet stringent extrusion requirements. The inventive composition is particularly suited for MMV tubing in heat exchanger applications due to its ability to resist excessive grain growth during exposure to elevated temperatures such as those present during brazing cycles.

The invention also solves the problems associated with zinc coatings since the superb corrosion resistance of an article made from the inventive composition eliminates the need for any zinc coating.

In one embodiment, the aluminum alloy composition consists essentially of, in weight percent;

- between about 0.05 and 0.5% silicon, preferably between about 0.06 and 0.25%;
- up to 0.7% copper, preferably, up to 0.5%, more preferably up to 0.35%, and most preferably up to 0.2%;
- less than 0.01% nickel;
- less than or equal to 1.0% magnesium, preferably less than 0.5%, more preferably less than 0.1%;
- up to 0.5% chromium, and when iron is between zero and 0.09%, the composition includes:
  - an amount of manganese between 0.05% and 0.50%, an amount of zinc between 0.10 and 0.50%, and an amount of zirconium between 0.05 and 0.40% (Mn+Zn+Zr), and
  - additional amounts of one of (a), (b), or (c), wherein:
    - (a) is an additional amount of manganese up to 0.70%, or an amount of vanadium between 0.05 and 0.50% (Mn or V);
    - (b) is either an additional amount of manganese up to 0.70% and an amount of titanium between about 0.10 and 0.40% (Mn+Ti), or an additional amount of manganese up to 0.70% and an amount of vanadium between 0.05 and 0.50% (Mn+V); and
    - (c) is an additional amount of manganese up to 0.70%, an amount of titanium between 0.10 and 0.40%, and an amount of vanadium between 0.05% and 0.50% (Mn+Ti+V);
- with the balance aluminum and inevitable impurities; and when iron is between 0.09% and 0.80%, the composition includes:
  - an amount of manganese between 0.05% and 2.00%, and an amount of zinc between 0.10 and 0.50% (Mn+Zn); and
  - additional amounts of one of (a), (b), or (c), wherein:
    - (a) is an amount of titanium between 0.10 and 0.40%, or an amount of vanadium between 0.05 and 0.50%, or an amount of zirconium between 0.05% and 0.40% (Ti or V or Zr);
    - (b) is either an amount of titanium between about 0.10 and 0.40% and an amount of vanadium between 0.05 and 0.50% (Ti+V), or an amount of titanium between 0.10 and 0.40% and an amount of zirconium between 0.05 and 0.40% (Ti+Zr); or and an amount of vanadium between 0.05 and 0.50% and an amount of zirconium between 0.05 and 0.40% (V+Zr); and
    - (c) is an amount of zirconium between 0.05% and 0.40%, and an amount of titanium between 0.10 and 0.40%, and an amount of vanadium between 0.05% and 0.50% (Zr+Ti+V);

with the balance aluminum and inevitable impurities.

The lower limit of 0.05% for the various alloys is intended to distinguish the amounts of the alloying elements from levels that would be considered to be impurity levels. The ranges exceeding 0.05% or between 0.05% and another amount are intended to denote a specific alloying element amount, such an amount imparting properties to the alloy that would otherwise not be present with impurity levels.

The formulas depicted below show the composition variables as described above in groupings for better understanding. Formula I represents the low iron composition with Formula II representing the higher iron embodiment. The formulas take into account only the levels of manganese, titanium, vanadium, zinc, and zirconium. The levels of copper, silicon, nickel, chromium, magnesium, and aluminum are as stated above. More preferred levels of the iron in Formula I are between about 0.05 and 0.08%, and for Formula II, iron ranges between about 0.10 and 0.20%.

I $$\underbrace{(Mn + Zn + Zr)}_{\text{base}} + [\underbrace{(Mn \text{ or } V)}_{(a)} \text{ or } \underbrace{(Mn + Ti \text{ or } Mn + V)}_{(b)} \text{ or } \underbrace{(Mn + Ti + V)}_{(c)}]$$

II $$\underbrace{(Mn + Zn)}_{\text{base}} + [\underbrace{(Ti \text{ or } V \text{ or } Zr)}_{(a)} \text{ or } \underbrace{(Ti + V \text{ or } Ti + Zr \text{ or } V + Zr)}_{(b)} \text{ or } \underbrace{(Ti + V + Z}_{(c)}$$

All further recitations of percentages are in weight percent.

The controlled levels of iron, manganese, zinc, zirconium, vanadium, and titanium assist in modifying the recrystallization behavior of the material and provide a hindrance to grain boundary movement at elevated temperatures, thereby significantly reducing grain growth. As evidenced by the specified levels of the various elements and combinations thereof, the alloying elements should be combined together in the proper amounts and combinations so that balance is maintained between the necessary corrosion resistance and grain size control and other important manufacturing considerations such as cost of alloying additions, hot workability, formability, brazeability, mechanical properties, and the like.

For Formula I (low iron), preferred and more preferred or target amounts are shown in Table IA. In addition, for the Formula I base, zinc is preferably between about 0.10 and 0.40%, and more preferably between about 0.10 and 0.30%. Zirconium is preferably between about 0.10 and 0.30%, and more preferably between about 0.10 and 0.25%. The manganese in the base of Formula I preferably ranges between 0.05 and 0.40%, with a more preferred range of between 0.05 and 0.30%.

The preferred and target amounts for the high iron Formula II are depicted in Table IB. In Formula II, the preferred levels of zinc are the same as for Formula I. For manganese in Formula II, preferred amounts range between 0.20 and 1.50%, with more preferred amounts between about 0.30 and 1.20%.

TABLE IA

| | Low Iron | | | | | | | | |
|---|---|---|---|---|---|---|---|---|---|
| | (a) | | (b) | | | | (c) | | |
| low Fe | Mn* | or V | Mn* | + V | Mn* | + Ti | Mn* | + Ti | + V |
| preferred | 0.2–1.0 | 0.10–0.35 | 0.2–1.0 | 0.10–0.35 | 0.2–1.0 | 0.10–0.20 | 0.2–1.0 | 0.10–0.20 | 0.10–0.35 |
| Target | 0.3–0.8 | 0.10–0.25 | 0.3–0.8 | 0.10–0.25 | 0.3–0.8 | 0.12–0.18 | 0.3–0.8 | 0.12–0.18 | 0.10–0.25 |

*The amounts of manganese in the preferred range reflect the total amounts, including that found in the base and either (a), (b), or (c)

TABLE IB

| | High Iron | | | | | | | | | | | |
|---|---|---|---|---|---|---|---|---|---|---|---|---|
| High | (a) | | | (b) | | | | | | (c) | | |
| Fe | Ti | or V | or Zr | Ti | + V | Ti | + Zr | V | + Zr | Ti | + V | + Zr |
| Pref. | 0.10–0.20 | 0.10–0.35 | .10–.30 | 0.10–0.20 | 0.10–0.35 | .10–.20 | .10–.30 | 0.10–0.35 | .10–.30 | 0.10–0.20 | 0.10–0.35 | .10–.30 |
| Target | 0.12–0.18 | 0.10–0.25 | 0.10–0.25 | 0.12–0.18 | 0.10–0.25 | 0.12–0.18 | 0.10–0.25 | 0.10–0.25 | 0.10–0.25 | 0.12–0.18 | 0.10–0.25 | 0.10–0.25 |

More preferred embodiments include the low iron composition with vanadium alone, manganese alone, or the combination of zirconium and titanium.

For high iron, more preferred embodiments include the use of titanium or titanium and zirconium.

The inventive composition can be made into any article via casting and hot working, but it is preferred that the composition is made into shapes such as billets and the like for extrusion. Conventional casting, and heat treating techniques can be employed to make the shapes. Similarly, the shapes can be subjected to conventional processing to produce a hot worked shape such as an extruded article, e.g., micro-multivoid tubing. Of course, the composition can be made into other shapes such as sheet, strip, or the like.

In the mode of extruding a hollow elongate article, the aluminum alloy shape is heated to an elevated temperature, e.g., 500–650° C., and passed through an extrusion die to form an extruded product.

In a preferred mode, the composition is made into a billet and extruded into flat micro-multivoid tubing for use in heat exchanger applications. In these uses, the tubing is bare and is brazed to a two sided braze clad fin stock to make the heat exchanger. Since these manufacturing techniques are well recognized in the art, a further description thereof is not deemed necessary for understanding of the invention. Of course, other extrusion applications can be employed and other extruded or worked shapes can be made from the inventive aluminum alloy composition. The term "bare" is intended to mean the surface of the article made from the inventive composition is uncoated with another material. For example, certain articles employed for brazing applications are coated with a corrosion protecting material.

Figure 2:
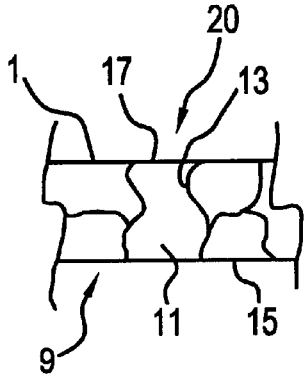
FIG. 2 PRIOR ART
FIG. 2 is a schematic representation of an exemplary post-braze grain structure for a portion of a prior art MMV tubing.
Figure 3:
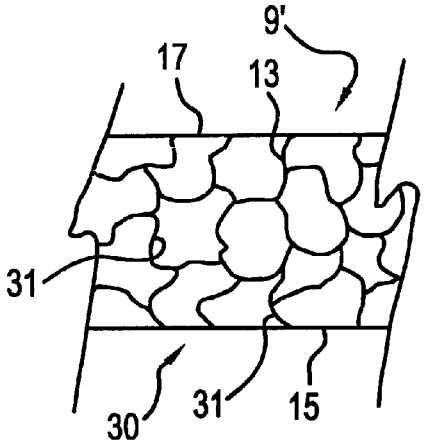
FIG. 3 shows a post-braze grain structure of a MMV tubing using a composition according to the invention.

When extruding MMV tubing from the inventive composition, the problems found in prior art tubing as shown in FIG. 2 are overcome. Referring to FIG. 3, a section 9' is depicted with a fine grain structure 30. The fineness of the grain structure precludes the existence of large grains which may traverse the entire sidewall thickness. With the grain structure 30, the section 9' lacks grain boundaries extending through the sidewall thickness and does not allow a preferential site for intergranular corrosion to occur. The grain structure 30 forms a number of grain boundaries 31 that provide a circuitous route for grain boundary corrosion which is unlike what is seen in the prior art tubing. Without the massive grains and sidewall-spanning grain boundaries, there are no or few sites in the MMV tubing of the invention for corrosion to take place. Consequently, the corrosion performance of such tubing vastly exceeds that of the prior art. For tubing having a wall thickness about 0.30 mm or 300 microns, the grain size in the post-braze condition ranges preferably between 30 and 45 microns. With this size, roughly 7–10 grains span the width of the side-or endwall. Of course, the grain size could be larger if the tubing wall thickness were greater.

In order to demonstrate the effectiveness of the inventive composition in terms of corrosion resistance and extrudability, comparative investigations were performed. Table II depicts ranges for a series of compositions following the teachings of the invention. The alloys were subjected to SWAAT testing to determine corrosion resistance performance. Since SWAAT testing per the ASTM standard G85, Annex 3, is well known, the details of the testing are not believed to be necessary for understanding of the results depicted below.

Figure 4:
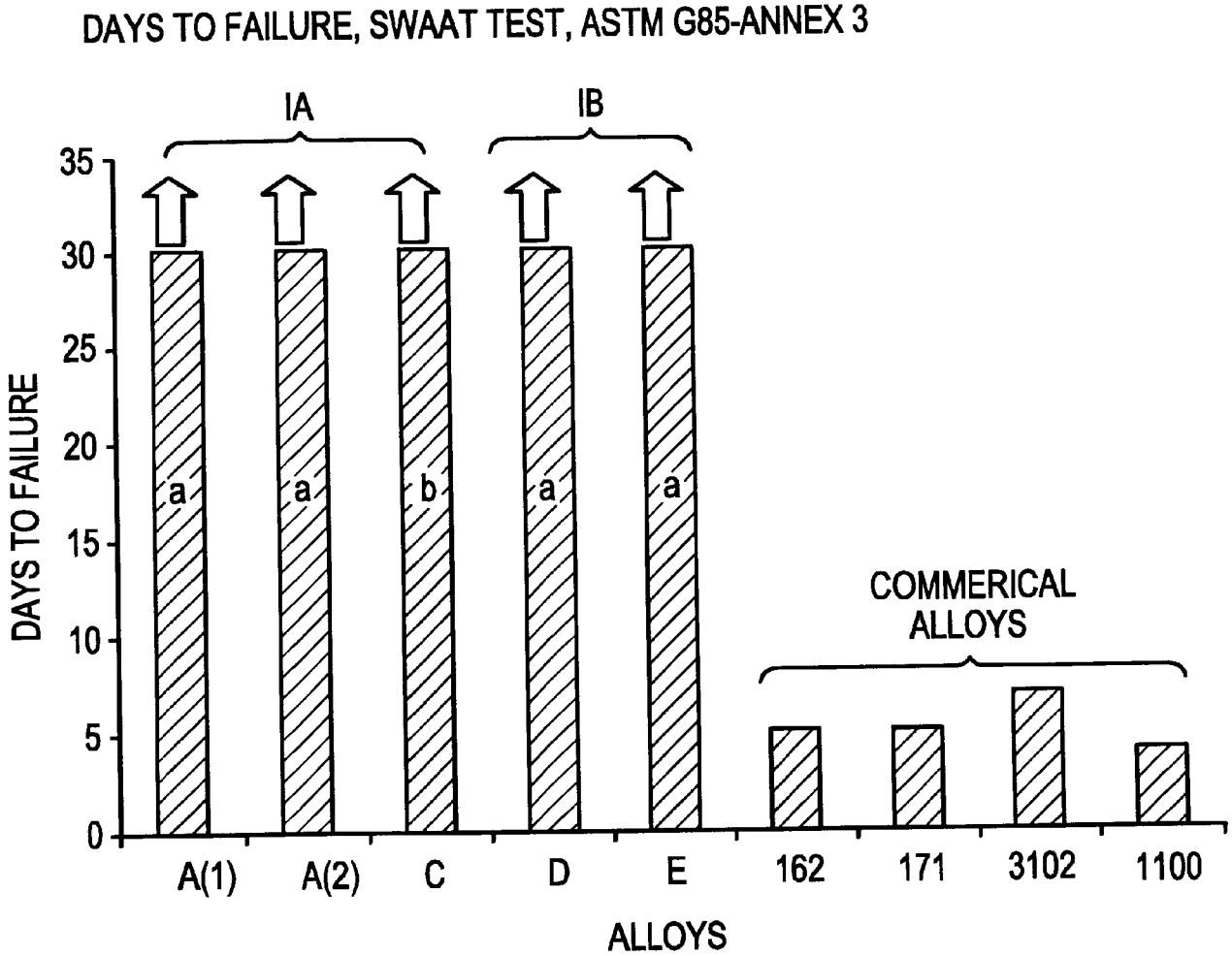
FIG. 4 is a bar graph showing comparative corrosion resistance values for alloys of the invention and conventional alloys.

FIG. 4 shows that a number of alloys corresponding to the alloys defined in Table II were subjected to testing for 30 days or more, and that all samples embodying the invention passed the testing after 30 days. In contrast and for the same SWAAT testing, the conventional alloys 162, 171, 3102, and 1100 all failed the testing regimen before 10 days had elapsed (these prior art alloy compositions are well known and a detailed description of the actual compositions is not deemed necessary for understanding of the invention). Thus, alloys according to the invention as set for the in Tables 1(A) and 1(B) exhibit vastly superior corrosion resistance than the prior art alloys.

TABLE II

IDENTIFICATION & CHEMICAL COMPOSITION LIMITS FOR ALLOYS INDICATED IN TABLE 1 AND FIG. 4 (in wt. %)

| Alloy | Ref. to Table IA & IB | Si | Fe | Cu | Mn | Mg | Cr | Zn | Ti | Zr | V |
|---|---|---|---|---|---|---|---|---|---|---|---|
| A(1) | IA(a) | 0.05–0.50 | 0.0–0.09 | 0.0–0.7 | 0.05–1.2 | 0.0–1.0 | 0.0–0.5 | 0.05–0.5 | | 0.05–0.4 | 0.05–0.5 |
| A(2) | IA(a) | 0.05–0.50 | 0.0–0.09 | 0.0–0.7 | 0.05–1.2 | 0.0–1.0 | 0.0–0.5 | 0.05–0.5 | | 0.05–0.4 | 0.05–0.5 |
| C | IA(b) | 0.05–0.50 | 0.0–0.09 | 0.0–0.7 | 0.05–1.2 | 0.0–1.0 | 0.0–0.5 | 0.05–0.5 | 0.1–0.4 | 0.05–0.4 | |
| D | IB(a) | 0.05–0.50 | 0.09–0.8 | 0.0–0.7 | 0.05–2.0 | 0.0–1.0 | 0.0–0.5 | 0.05–0.5 | | 0.05–0.4 | |
| E | IB(a) | 0.05–0.50 | 0.09–0.8 | 0.0–0.7 | 0.05–2.0 | 0.0–1.0 | 0.0–0.5 | 0.05–0.5 | 0.1–0.4 | | |

The compositions in Table II were extruded as MMV tubing and subjected to a high temperature to represent a conventional brazing cycle for comparison purposes.

Even if a prior art alloy may exhibit desirable corrosion resistance based on SWAAT testing, the alloy composition may not be suitable for extrusion using conventional conditions. Conventional extrusion conditions are those normally used to process the prior art alloys like 1100, 3102, 162, and 171 into tubing for heat exchanger application and are well recognized in the art.

One significant aspect of the invention is the ability to combine excellent corrosion resistance, excellent grain growth resistance, and hot workability in one alloy. Hot workability, e.g., extrudability, is an important property, especially when manufacturing heat exchangers. The inventive composition not only exhibits corrosion resistance superior to that of the conventional alloys as shown in FIG. 4, but also superior grain growth resistance, and does so without a loss of hot workability characteristics. In other words, the inventive alloys exhibit hot workability that is the equivalent of that found in the conventional prior art alloys in these applications. Care is taken in the control of the alloying content and element selection such that corrosion resistance, grain growth resistance, and hot workability are present in the final alloy. Without adequate extrudability, the alloys are not adaptable for heat exchanger application in the form of tubing even if adequate corrosion resistance and grain growth resistance may be present.

It should also be understood that any alloying addition that can be used interchangeably with those disclosed (via similar periodic group, etc.) and known in the art is also protected through this application.

As such, an invention has been disclosed in terms of preferred embodiments thereof which fulfills each and every one of the objects of the present invention as set forth above and provides a new and improved aluminum alloy composition, an article made therefrom, a method of use in brazing applications, and a method of manufacture.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. An aluminum alloy composition consisting essentially of, in weight percent;

between about 0.05 and 0.5% silicon;

up to 0.7% copper;

less than 0.01% nickel;

less than or equal to 1.0% magnesium;

up to 0.5% chromium;

between zero and 0.09% iron;

between 0.2 and 1.0% manganese;

between 0.10% and 0.20% titanium;

between 0.10% and 0.35% vanadium;

between 0.10 and 0.30% zirconium;

between 0.10 and 0.40% zinc; and with the balance aluminum and inevitable impurities.

2. The composition of claim 1, wherein the total amount of manganese ranges between about 0.05 and 0.4%, the amount of titanium ranges between about 0.12 and 0.18%, the amount of vanadium ranges between about 0.10 and 0.25%, the amount of zirconium ranges between about 0.10 and 0.25%, and the amount of zinc ranges between about 0.10 and 0.30%.

3. An article made from the composition of claim 1.

4. The article of claim 3, wherein the article is a heat exchanger tubing product.

5. The article of claim 4, wherein the heat exchanger tubing product is bare micro-multivoid tubing.

6. An aluminum alloy composition consisting essentially of, in weight percent;

between about 0.05 and 0.5% silicon;

up to 0.7% copper;

less than 0.01% nickel;

less than or equal to 1.0% magnesium;

up to 0.5% chromium;

between 0.09 and 0.80% iron;

between 0.2 and 1.5% manganese;

between 0.10% and 0.20% titanium;

between 0.10% and 0.35% vanadium;

between 0.10 and 0.30% zirconium;

between 0.10 and 0.40% zinc; and with the balance aluminum and inevitable impurities.

7. The composition of claim 6, wherein the total amount of manganese ranges between 0.05 and 0.4%, the amount of zinc ranges between about 0.10 and 0.30%, the amount of titanium ranges between about 0.12 and 0.18%, the amount of vanadium ranges between about 0.10 and 0.25%, and the amount of zirconium ranges between about 0.10 and 0.25%.

8. An article made from the composition of claim 6.

9. The article of claim 8, wherein the article is a heat exchanger tubing product.

10. The article of claim 9, wherein the heat exchanger tubing product is bare micro-multivoid tubing.

11. An aluminum alloy composition consisting essentially of, in weight percent;

between about 0.05 and 0.5% silicon;

up to 0.7% copper;

less than 0.01% nickel;

less than or equal to 1.0% magnesium;

up to 0.5% chromium;

between zero and 0.09% iron;

between 0.10 and 0.40% zirconium;

between 0.10 and 0.50% zinc;

between 0.05% and 0.50% of manganese; and between 0.05% and 0.50% vanadium;

with the balance aluminum and inevitable impurities.

12. An article made from the composition of claim 11.

13. The article of claim 12, wherein the article is a heat exchanger tubing product.

14. The article of claim 13, wherein the heat exchanger tubing product is bare micro-multivoid tubing.

15. An aluminum alloy composition consisting essentially of, in weight percent;

between about 0.05% silicon;

up to 0.2% copper;

less than 0.01% nickel;

less than or equal to 0.5% magnesium;

up to 0.5% chromium, iron between 0.09% and 0.25%, an amount of manganese between 0.3% and 1.2%, an amount of zinc between 0.10 and 0.50%; and either an amount of titanium between 0.10 and 0.40%, or an amount of zirconium between 0.05% and 0.40%; or an amount of titanium between 0.10 and 0.40% and an amount of zirconium between 0.05 and 0.40%, with the balance aluminum and inevitable impurities.

16. The composition of claim 15, wherein the iron ranges between 0.1 and 0.2%.

17. The composition of claim 15, wherein the copper is more than 0.03% and up to 0.2%.

18. The composition of claim 15, further comprising titanium alone.

19. The composition of claim 18, wherein the amount of titanium ranges between 0.1 and 0.2%.

20. The composition of claim 15, further comprising zirconium alone.

21. The composition of claim 15, further comprising titanium and zirconium.

22. The composition of claim 20, wherein the amount of zirconium ranges between about 0.1 and 0.25%.

23. The composition of claim 21, wherein the amount of titanium ranges between 0.1 and 0.2%, and the amount of zirconium ranges between about 0.1 and 0.25%.

24. An article made from the composition of claim 18.

25. The article of claim 24, wherein the article is a heat exchanger tubing.

26. The article of claim 25, wherein the heat exchanger tubing is bare multi-void tubing.

* * * * *

UNITED STATES PATENT AND TRADEMARK OFFICE

CERTIFICATE OF CORRECTION

PATENT NO. : 6,503,446 B1
APPLICATION NO. : 09/616015
DATED : January 7, 2003
INVENTOR(S) : Baolute Ren et al.

It is certified that error appears in the above-identified patent and that said Letters Patent is hereby corrected as shown below:

In The Claims

Column 11, Line 17, delete "0.05%" and insert -- 0.05 and 0.5% --

Signed and Sealed this
Eighteenth Day of November, 2014

Michelle K. Lee

Michelle K. Lee
*Deputy Director of the United States Patent and Trademark Office*